US009711019B2

(12) United States Patent
Ren et al.

(10) Patent No.: US 9,711,019 B2
(45) Date of Patent: Jul. 18, 2017

(54) MARKER WITH A BONE SHAPED MAGNETIC CORE

(71) Applicants: Zhaohui Ren, Shanghai (CN); Ding Jin, Pudong Shanghai (CN); Fei Xue, Shanghai (CN)

(72) Inventors: Zhaohui Ren, Shanghai (CN); Ding Jin, Pudong Shanghai (CN); Fei Xue, Shanghai (CN)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 14/956,456

(22) Filed: Dec. 2, 2015

(65) Prior Publication Data

US 2016/0321893 A1 Nov. 3, 2016

(30) Foreign Application Priority Data

Apr. 30, 2015 (CN) ..... 2015 1 0218663

(51) Int. Cl.
*G08B 13/24* (2006.01)

(52) U.S. Cl.
CPC ..... *G08B 13/2408* (2013.01)

(58) Field of Classification Search
CPC ..... G08B 13/2408
See application file for complete search history.

(56) References Cited

U.S. PATENT DOCUMENTS 7,075,440 B2 * 7/2006 Fabian ..... G08B 13/2408 340/551

* cited by examiner

*Primary Examiner* — Leon Flores
(74) *Attorney, Agent, or Firm* — Fox Rothschild LLP; Robert J. Sacco; Carol E. Thorstad-Forsyth

(57) ABSTRACT

Systems (100) and methods (1700) for providing a marker (102). The methods comprise forming a magnetic core (200) having a bone shape defined by two end portions (208, 212) and a center potion (210) disposed between the two end portions. The end portions each have a cross-sectional area larger than a cross-sectional area of the center portion. A coil (224) is disposed around the center portion. The coil is coupled to a passive electronic component (206) so as to form a resonator. The resonator is disposed in a housing (126) of the marker. The resonator resonates when an interrogation signal is produced by a transmitter circuit (112) located remote from and in proximity to the marker, whereby a variation in a magnetic field occurs.

20 Claims, 10 Drawing Sheets

MARKER WITH A BONE SHAPED MAGNETIC CORE

BACKGROUND OF THE INVENTION

Statement of the Technical Field

The present invention relates generally to magnetic core antennas. More particularly, the present invention relates to magnetic core antennas for use in a variety of systems such as an Electronic Article Surveillance ("EAS") detection system or a Radio Frequency Identification ("RFID") system.

Description of the Related Art

EAS and RFID detection systems are typically used to protect and track assets. In an EAS detection system, an interrogation zone is established at the perimeter of a protected area. For example, the interrogation zone is in the vicinity of an exit from a facility such as a retail store. The interrogation zone is established by an interrogation device positioned adjacent to the desired interrogation zone. The interrogation device comprises an antenna which transmits an electromagnetic interrogation signal into an interrogation zone so as to create an electromagnetic field of sufficient strength and uniformity therein.

EAS markers (attached to each asset to be protected) respond in some known electromagnetic manner to the electromagnetic interrogation signal. When an asset is properly purchased or otherwise authorized for removal from the protected area, the EAS marker is either removed therefrom or deactivated such that the presence of the asset within the interrogation zone does not cause issuance of an alarm. In contrast, if the EAS marker is not removed or deactivated, then electromagnetic interrogation signal causes a response from the EAS marker when present within the interrogation zone. A detection antenna detects the EAS marker's response indicating that an active EAS marker is presently within the interrogation zone. An associated controller provides an indication of this condition, such as issuing an audio alarm for preventing an unauthorized removal of the asset from the protected area. In this regard, the alarm can be the basis for initiating one or more appropriate responses depending upon the nature of the facility.

An RFID detection system utilizes an RFID marker to track assets for various purposes, such as taking inventory. The RFID marker stores data associated with the asset. An RFID reader scans the RFID markers by transmitting an RFID interrogation signal at a known frequency. RFID markers respond to the RFID interrogation signal with RFID response signals including asset-related data associated with the assets being protected thereby. The RFID reader detects the response signals and decodes the asset-related data.

SUMMARY OF THE INVENTION

The present disclosure concerns implementing systems and methods for providing a marker (e.g., an EAS marker). The methods involve forming a magnetic core having a bone shape defined by two end portions (or flanges) and a center portion disposed between the two end portions. The end portions each have a cross-sectional area larger than a cross-sectional area of the center portion. A coil is disposed around the center portion, and retained thereon by the two end portions. The coil is coupled to a passive electronic component so as to form a resonator. For example, the coil is connected in series to form an LC resonator. The resonator is disposed in a housing of the marker. The resonator resonates when an interrogation signal is produced by a transmitter circuit located remote from and in proximity to the marker, whereby a variation in a magnetic field occurs.

In some scenarios, the passive electronic component is positioned relative to the magnetic core such that the passive electronic component resides entirely within an area defined between the two end portions of the magnetic coil. Additionally or alternatively, the coil: has a uniform or non-uniform distribution about a length of the center portion of the magnetic core; and/or comprises at least two sets of windings that are spaced apart from each other. The windings of each set of windings are equally or not equally spaced apart along a respective segment of the center portion of the magnetic core. The sets of windings may have at least one of different spacing between the windings and different number of windings.

BRIEF DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
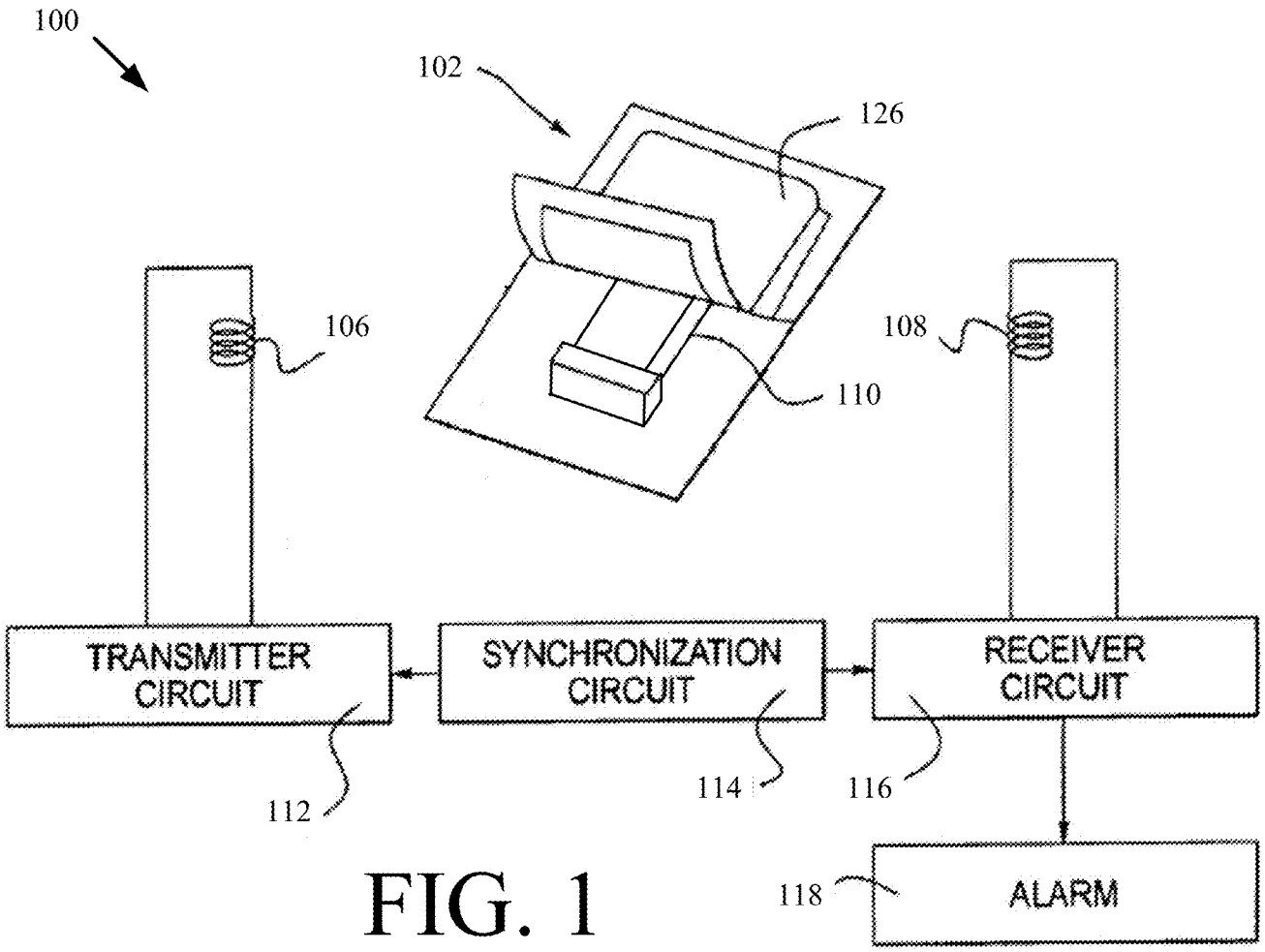
FIG. 1 is a perspective view of an exemplary EAS system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present disclosure concerns EAS and RFID markers comprising magnetic core resonant circuits. Conventional magnetic core resonant circuits include a cylindrical core. In contrast, the magnetic core employed herein has a generally bone shape. Ferrite has traditionally been used for the cylindrical core. The ferrite cylindrical core has an increased size as compared to other types of magnetic cores. The increased size provides an improve detection performance of the EAS detection systems and/or RFID systems. Despite this fact, these types of conventional magnetic core resonant circuits suffer from certain drawbacks. For example, the magnetic core resonant circuits cause the EAS/RFID markers to have an increased overall weight, which is undesirable in many scenarios (e.g., clothing scenarios). As such, there is a need for a magnetic core resonant circuit which has a relatively small overall size and weight as compared to that of the conventional ferrite cylindrical resonant circuits. Such a magnetic core resonant circuit is described below.

The magnetic core resonant circuit described herein has a bone shaped core. A coil is disposed around a middle portion of the bone shaped core. The two ends of the coil are connected to a capacitor so as to form an LC resonant circuit. When a magnetic field passes through the bone shaped ferrite core, a relatively large amount of magnetic energy is collected thereby, as compared to the amount collected by conventional resonant circuits having cylindrical ferrite cores. As such, the EAS/RFID markers of the present invention (i.e., those with the resonant circuit having a bone-shaped magnetic core) have overall better performance as compared to that of EAS/RFID markers employing conventional resonant circuits with cylindrical ferrite cores.

EAS System

Referring now to FIG. 1, there is provided schematic illustrations useful for understanding an exemplary EAS system 100 in accordance with the present invention. The EAS system 100 comprises a monitoring system 106-108, 112-118 and at least one marker 102. The marker 102 may be attached to an article to be protected from unauthorized removal from a business facility (e.g., a retail store). The monitoring system comprises a transmitter circuit 112, a synchronization circuit 114, a receiver circuit 116 and an alarm 118.

During operation, the monitoring system 106-108, 112-118 establishes a surveillance zone in which the presence of the marker 102 can be detected. The surveillance zone is usually established at an access point for the controlled area (e.g., adjacent to a retail store entrance and/or exit). If an article enters the surveillance zone with an active marker 102, then an alarm may be triggered to indicate possible unauthorized removal thereof from the controlled area. In contrast, if an article is authorized for removal from the controlled area, then the marker 102 can be deactivated and/or detached therefrom. Consequently, the article can be carried through the surveillance zone without being detected by the monitoring system and/or without triggering the alarm 118.

The operations of the monitoring system will now be described in more detail. The transmitter circuit 112 is coupled to the antenna 106. The antenna 106 emits Radio Frequency ("RF") bursts at a predetermined frequency (e.g., 58 KHz) and a repetition rate (e.g., 60 Hz), with a pause between successive bursts. In some scenarios, each RF burst has a duration (e.g., 1.6 ms). The transmitter circuit 112 is controlled to emit the aforementioned RF bursts by the synchronization circuit 114, which also controls the receiver circuit 116. The receiver circuit 116 is coupled to the antenna 108. The antenna 106, 108 comprises close-coupled pick up coils of N turns (e.g., 100 turns), where N is any number.

When the marker 102 resides between the antennas 106, 108, the RF bursts transmitted from the transmitter 112, 108 cause a signal to be generated by the marker 102. In this regard, the marker 102 comprises a resonator 110 disposed in a housing 126. The RF bursts emitted from the transmitter 112, 108 drive the resonator 110 to oscillate at a resonant frequency (e.g., 58 KHz). As a result, a signal is produced with an amplitude that decays exponentially over time.

The synchronization circuit 114 controls activation and deactivation of the receiver circuit 116. When the receiver circuit 116 is activated, it detects signals at the predetermined frequency (e.g., 58 KHz) within first and second detection windows. In the case that an RF burst has a duration of about 1.6 ms, the first detection window will have a duration of about 1.7 ms which begins at approximately 0.4 ms after the end of the RF burst. During the first detection window, the receiver circuit 116 integrates any signal at the predetermined frequency which is present. In order to produce an integration result in the first detection window which can be readily compared with the integrated signal from the second detection window, the signal emitted by the marker 102 should have a relatively high amplitude (e.g., greater than or equal to about 1.5 nWb).

After signal detection in the first detection window, the synchronization circuit 114 deactivates the receiver circuit 116, and then re-activates the receiver circuit 116 during the second detection window which begins at approximately 6 ms after the end of the aforementioned RF burst. During the second detection window, the receiver circuit 116 again looks for a signal having a suitable amplitude at the predetermined frequency (e.g., 58 kHz). Since it is known that a signal emanating from the marker 102 will have a decaying amplitude, the receiver circuit 116 compares the amplitude of any signal detected at the predetermined frequency during the second detection window with the amplitude of the signal detected during the first detection window. If the amplitude differential is consistent with that of an exponentially decaying signal, it is assumed that the signal did, in fact, emanate from a marker between antennas 106, 108. In this case, the receiver circuit 116 issues an alarm 118.

Resonator

Figure 2:
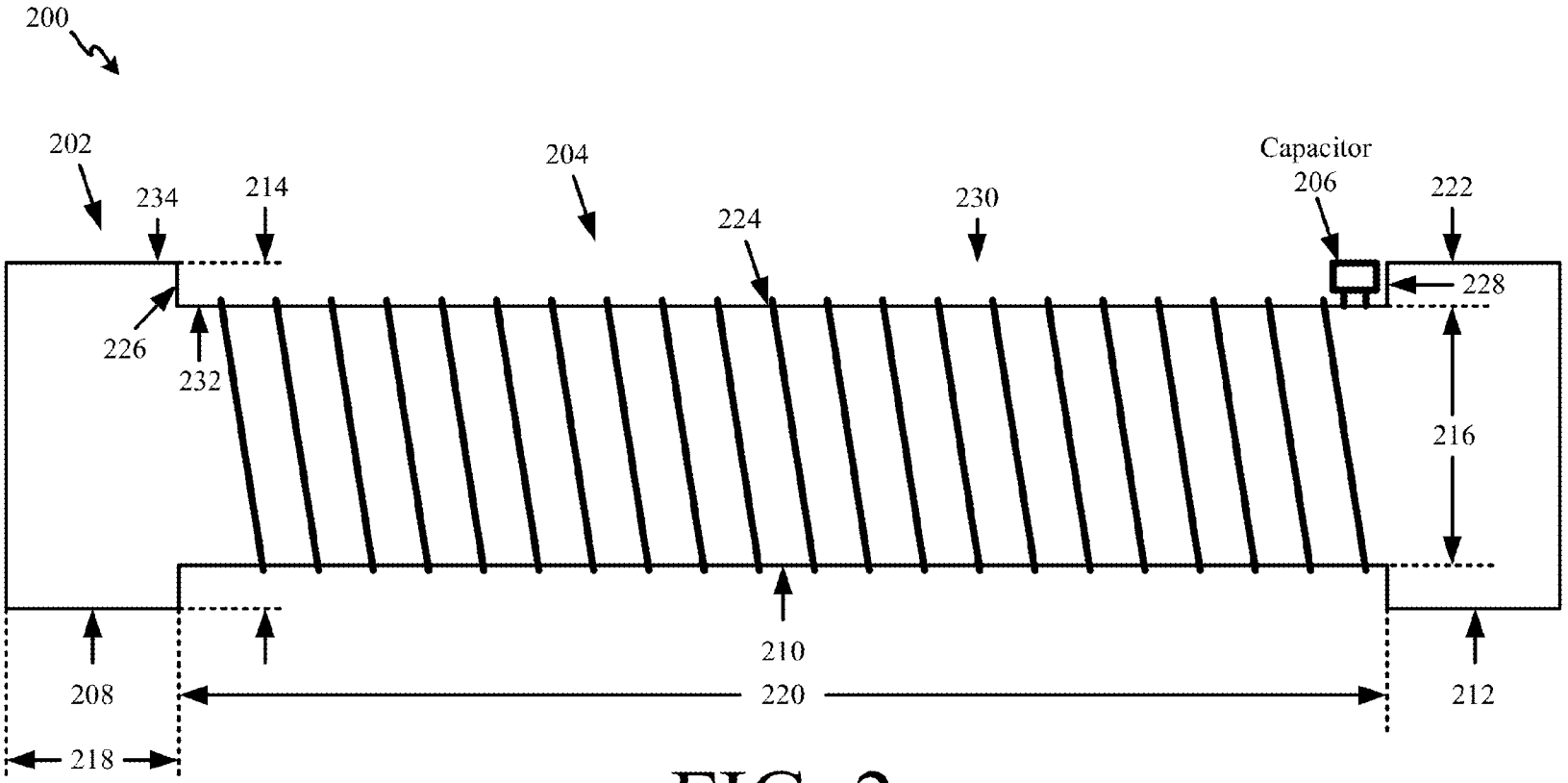
FIG. 2 is a schematic illustration of an exemplary architecture for a resonator having a bone shaped magnetic core.
Figure 3:
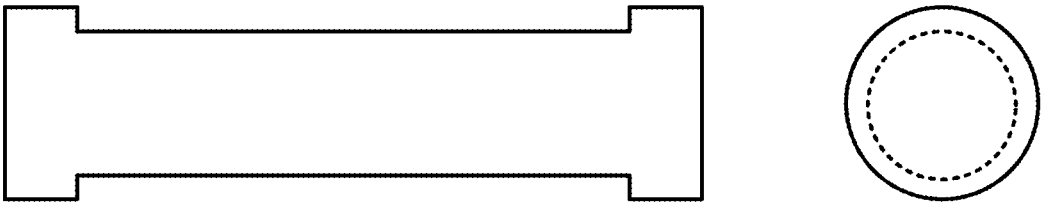
FIGS. 3-12 each provide a schematic illustration of another exemplary architecture for a resonator having a bone shaped magnetic core.
Figure 4:
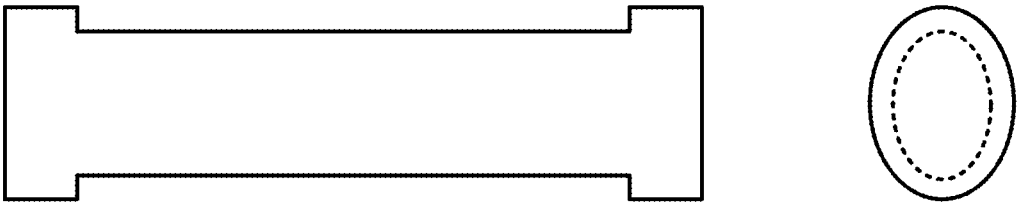
Figure 5:
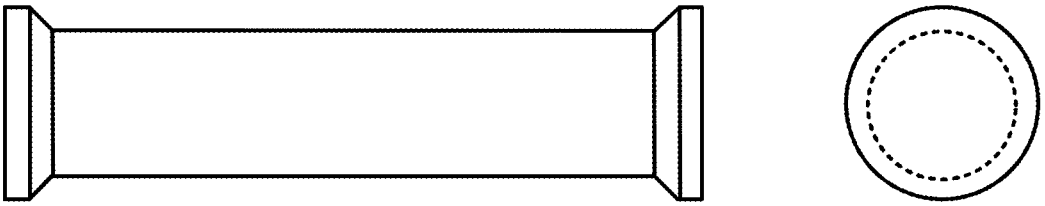
Figure 6:
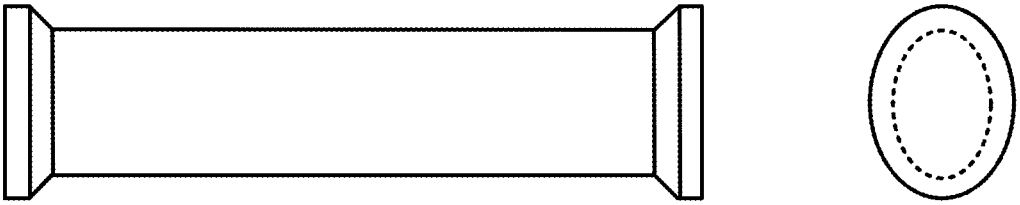
Figure 7:
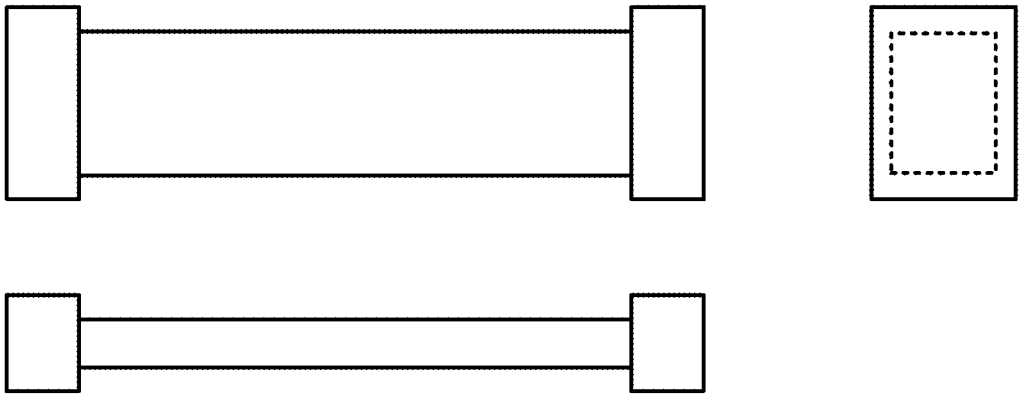
Figure 8:
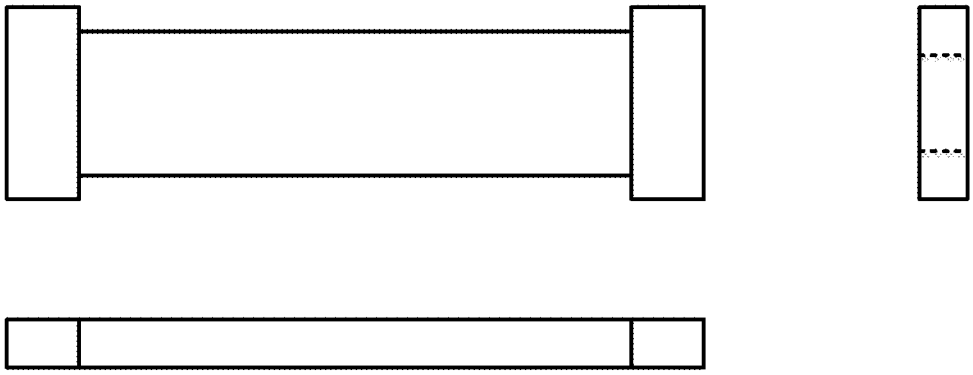
Figure 9:
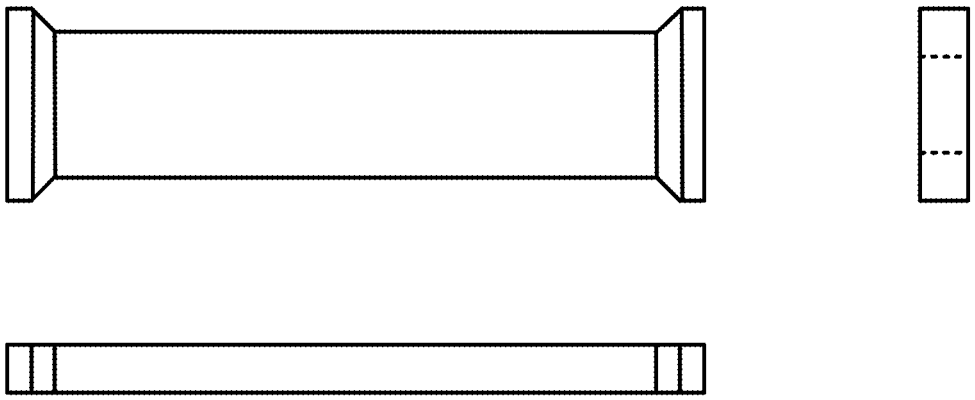
Figure 10:
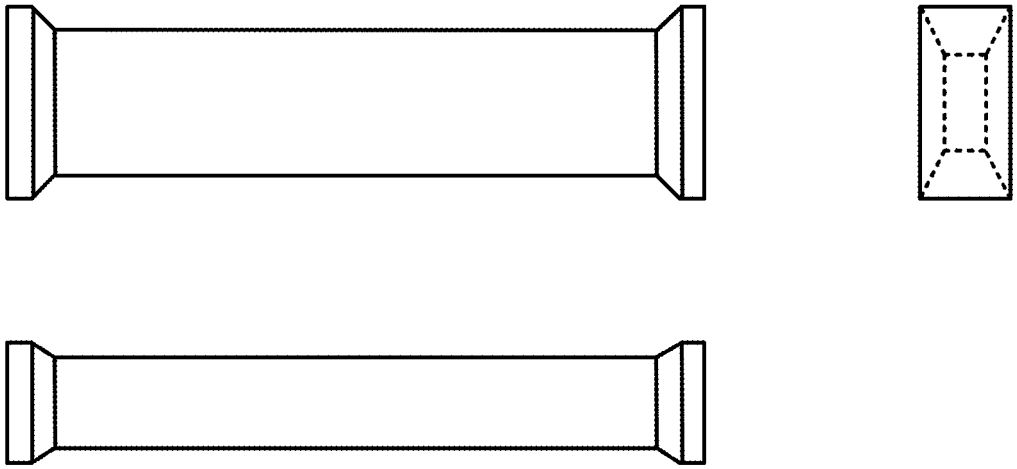
Figure 11:
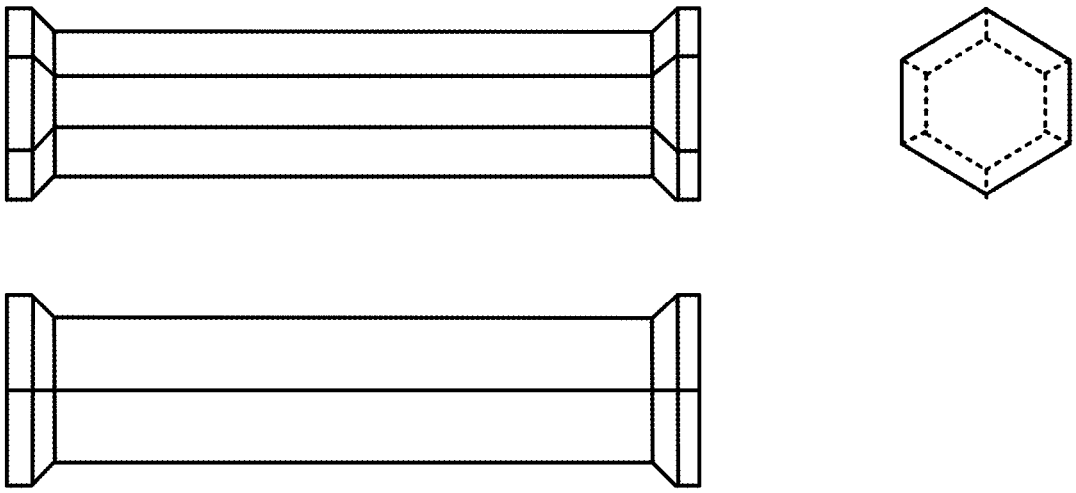
Figure 12:
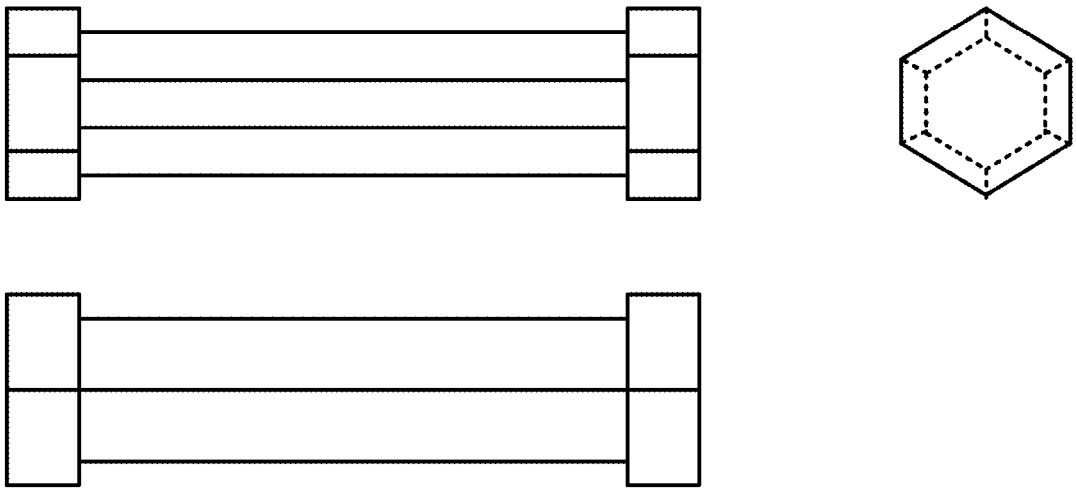

Referring now to FIG. 2, there is provided a schematic illustration of an exemplary architecture for a resonator 200 which may be used in the EAS/RFID marker 102 of FIG. 1. In this regard, it should be understood that resonator 110 of FIG. 1 is the same as or similar to resonator 200. As such, the following discussion of resonator 200 is sufficient for understanding resonator 110.

As shown in FIG. 2, the resonator 200 comprises a magnetic core 202 surrounded by a winding network 204. The magnetic core 202 may be constructed from a variety of known or to be known magnetic materials, such as ferrite. The winding network 204 includes one or more coils 224 connected in series with a capacitor 206 so as to provide an LC resonant circuit. LC resonant circuits are well known in the art, and therefore will not be described in detail herein. Still, it should be noted that the LC resonant circuit will resonate when RF bursts are produced by a transmitter circuit (e.g., transmitter circuit 112 of FIG. 1). The variations in its magnetic field can induce an AC signal in an antenna (e.g., antenna 108 of FIG. 1) of a receiver circuit (e.g., receiver circuit 116 of FIG. 1). This induced signal is used to indicate a presence of the EAS/RFID marker within a detection zone (e.g., the area between the transmitter circuit 112 and the receiver circuit 116 of FIG. 1).

The magnetic core 202 generally has a bone shape. In this regard, the core 202 comprises end portions (or flanges) 208, 212 and a center portion 210. The end portions 208, 212 each have a cross-sectional area larger than the cross-sectional area of the center portion 210. Accordingly, the height 214 of each end portion 208, 212 is greater than the height 216 of the center portion 210. However, the length 218 of each end portion 208, 212 is less than the length 220 of the center portion 210.

The winding network 204 is disposed on the center portion 210 of the magnetic core 202. The end portions 208, 212 provide a means to retain the winding network 204 on the center portion 210. In this regard, the distance 222 between surface 232 of the center portion and surface 234 of an end portion is selected to be greater than the thickness of the wire used to form the winding network 204. This arrangement of the winding network 204 on the core 202 saves valuable space of a marker (e.g., marker 102 of FIG. 1).

Valuable space of the marker can also be saved by selecting a capacitor 206 with an overall size that fits entirely within a space 230 between sidewalls 226, 228 of the end portions 208, 212 of the magnetic core 202. Of course, this capacitor/core arrangement is not required. As such, in other scenarios, the capacitor resides at least partially outside of space 230.

The coil 224 of the winding network 204 can have any number of windings greater than one. The coil 224 may have a uniform or non-uniform distribution about the length of the magnetic core 202. For example, in the scenario shown in FIG. 2, the coil 224 comprises a plurality of windings that are equally spaced apart and disposed along the entire length 220 of the center portion 204 of the magnetic core 202. In other scenarios, the coil 224 comprises (1) a first plurality of windings that are equally spaced apart along a first segment of the center portion 204 of the magnetic core 202, and (2) a second plurality of windings that are not equally spaced apart along a second segment of the center portion 204. In other scenarios, the coil 224 comprises two or more sets of windings that have different spacing between their windings. The sets of windings can also comprise the same or different number of windings. The spacing between adjacent sets of windings can be the same or different.

Referring now to FIGS. 3-12, there is provided schematic illustrations of various other exemplary architectures for a resonator that can be used in a marker. Any of the shown architectures can be used herein without limitation.

Simulation Results

Figure 13:
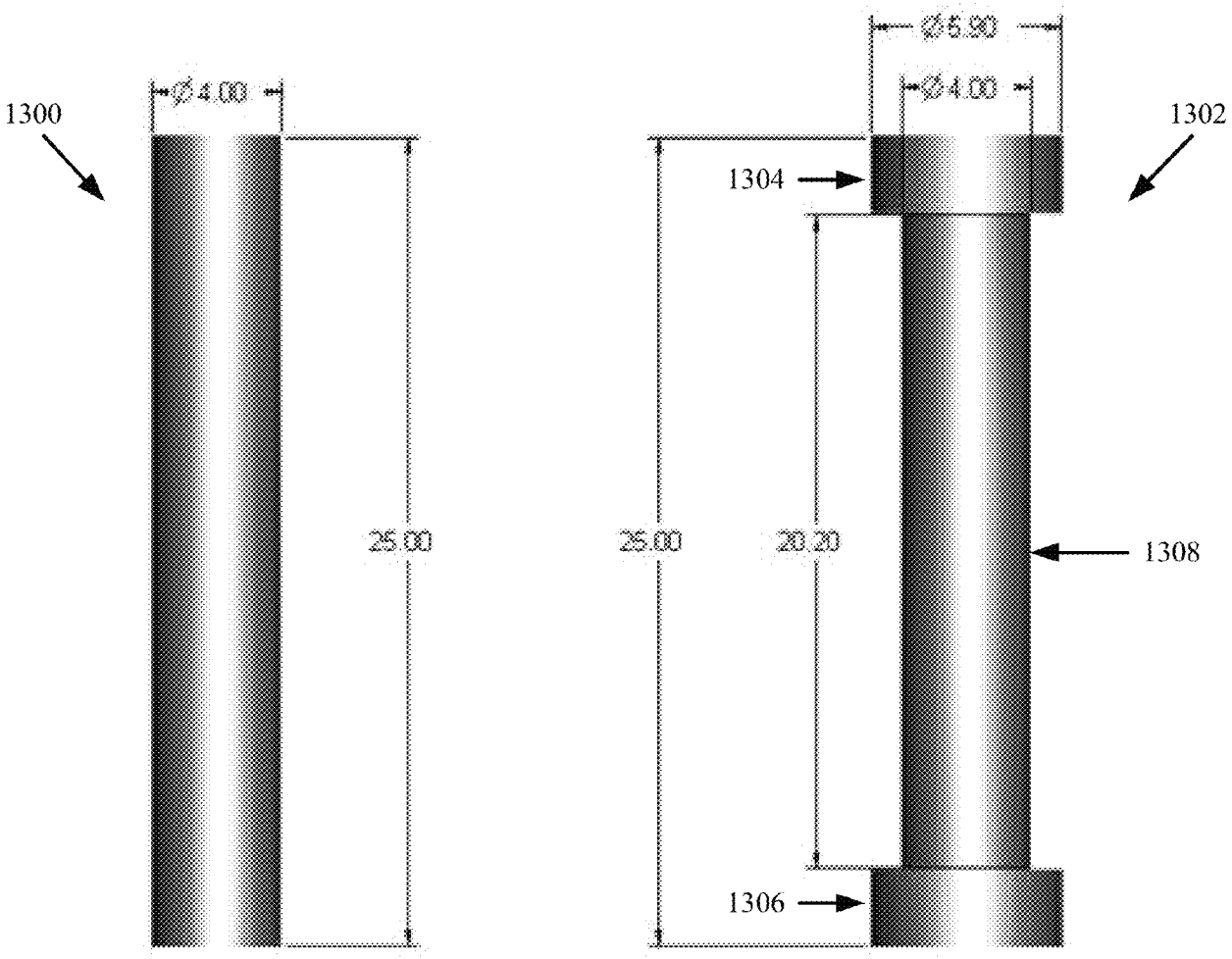
FIG. 13 is a schematic illustration of a cylindrical magnetic core and a bone shaped magnetic core.

Referring now to FIGS. 13-16, there are provide schematic illustrations that are useful in understanding why a resonator with a bone shaped magnetic core performs better than a conventional resonator with a cylindrical magnetic core. As shown in FIG. 13, two ferrite magnetic cores 1300, 1302 were used in a simulation. One was a traditional cylindrical ferrite core 1300, and the other was a bone shaped ferrite core 1302. The traditional cylindrical ferrite core 1300 has a length of 25 mm and a diameter of a 4 mm. The bone shaped ferrite core 1302 has a length of 25 mm as well. The end portions 1304, 1306 of the bone shaped ferrite core 1302 each have a diameter of 5.9 mm. The center portion 1308 has a diameter of 4 mm.

Figure 14:
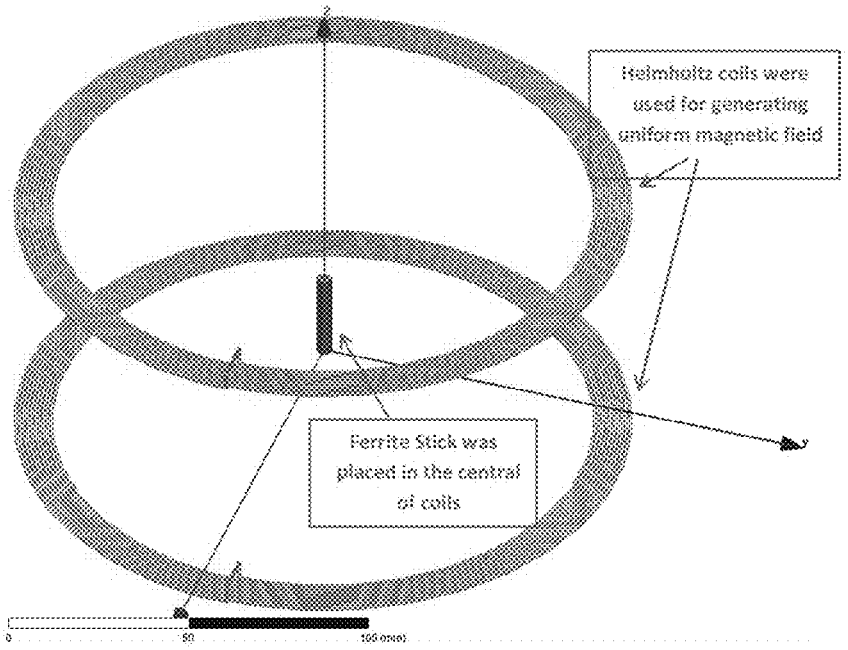
FIG. 14 is a schematic illustration of an exemplary system in which a magnetic field was generated around a cylindrical magnetic core.
Figure 15:
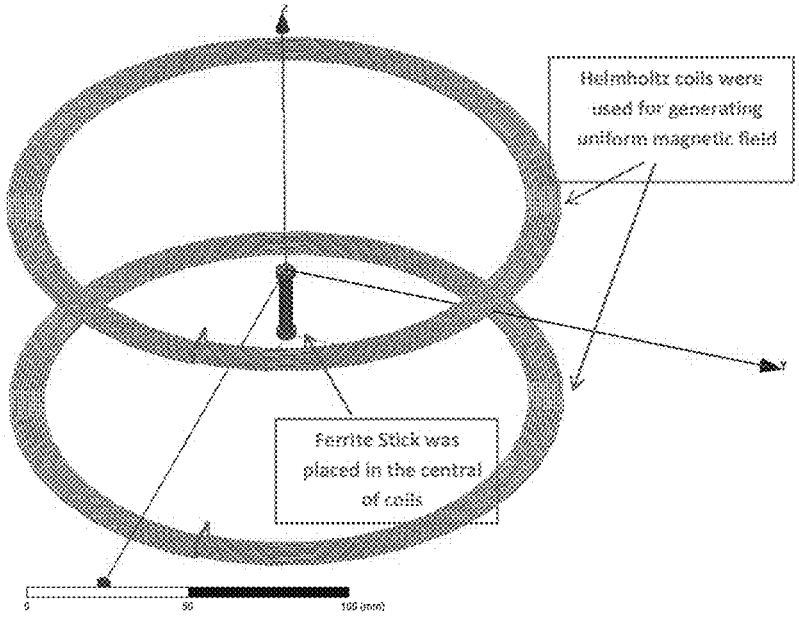
FIG. 15 is a schematic illustration of an exemplary system in which a magnetic field was generated around a bone shaped magnetic core.

In order to compare the performance characteristics of the two cores 1300 and 1302, the two cores were placed in the same uniform magnetic field, as shown in FIGS. 14-15. Helmholtz coils were used to generate the magnetic field. The cores 1300 and 1302 were placed in the same positions relative to the Helmholtz coils (e.g., the center axis of each core was aligned with the center axis of each respective Helmholtz coil). Thereafter, the internal magnetic strength of the two cores 1300 and 1302 were calculated and compared to each other.

Figure 16:
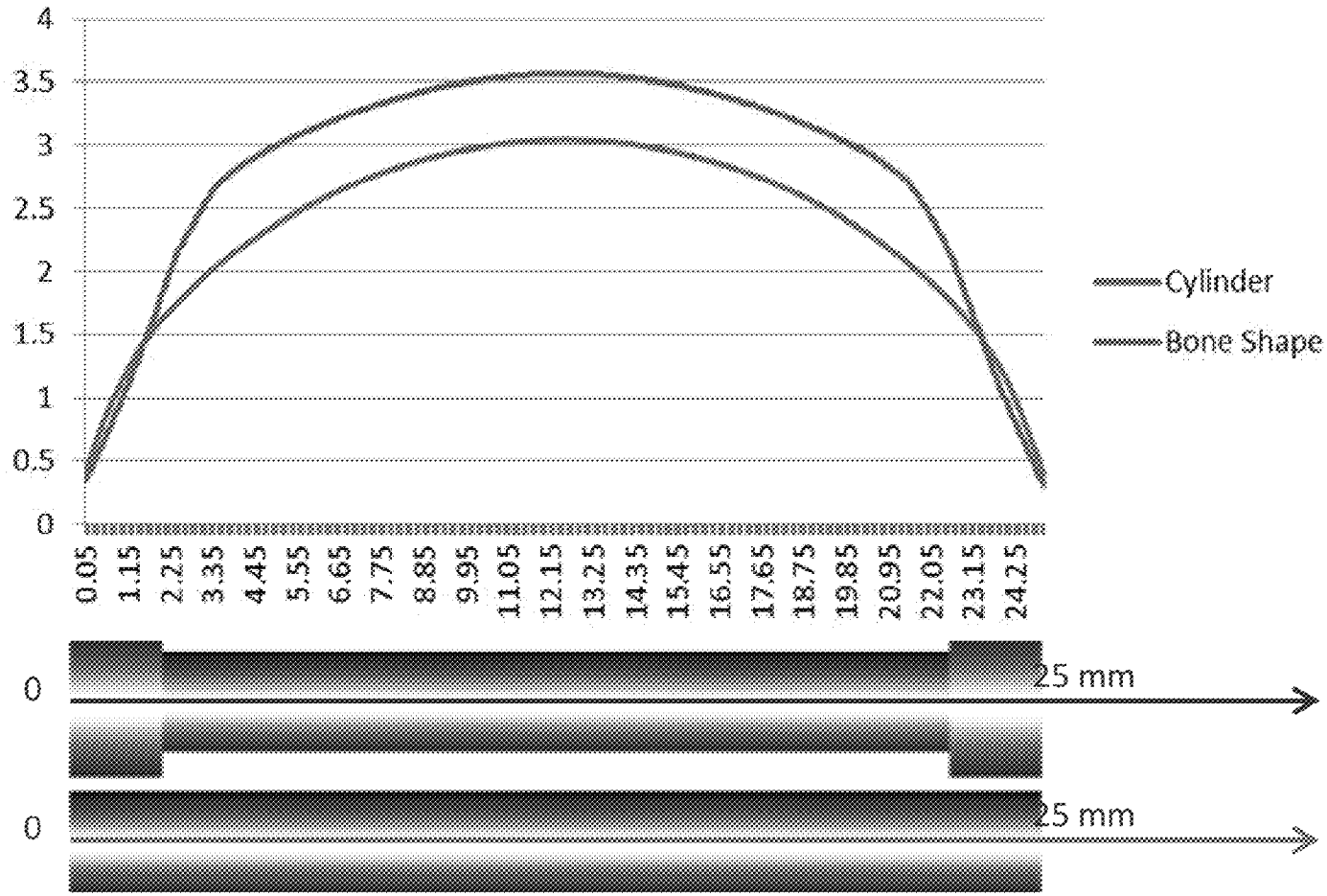
FIG. 16 is a graph plotting magnetic field strength against distance along a magnetic core.

These computations involve calculating the magnetic field strength of the Z axis of each core 1300, 1302. FIG. 16 shows the magnetic field strength computational results plotted against the distance along the cores 1300, 1302. As shown in FIG. 16, the magnetic field strength of the bone shaped core 1302 is generally bigger than that of the cylindrical core 1300.

The maximum magnetic field strength of the bone shaped core 1302 is 3.56585 A/m. Correspondingly, the maximum magnetic field strength of the cylindrical core 1300 is 3.041823 A/m. So, compared with the traditional cylindrical core 1300, the bone shaped core 1302 could enlarge the internal field strength of a marker by as much as 17 percent as evident from the following discussion.

The effective permeability μ(eff) of the two cores (due to their different geometry) are different although their intrinsic permeability μ is the same. This is why there are different magnetic fields shown in FIG. 16. Outside the ferrite, the magnetic field strength due to the ferrite could be coupled to a pickup coil. The pickup coil typical for the EAS application is usually an air coil loosely coupled to the ferrite cores. A voltage is induced by the magnetic field strength by the ferrite according to Faraday's law of induction defined by the following mathematical equations (1) and (2).

$$E = -n\frac{d\Phi}{dt} \tag{1}$$

where E is an electrodynamics force induced by alternating magnetic field, n is a number of coil turns, and Φ is a magnetic flux at the pickup coil.

$$\Phi=\mu HS \quad (2)$$

where μ is the permeability of pickup coil's medium, H is a magnetic field strength due to the ferrite core, and S is an effective area of the pickup coil. The permeability at the pickup coil (air coil, μ=μo) is constant regardless of the ferrite core used. By combining mathematical equations (1) and (2), the electrodynamics force can be defined by the following mathematical equation (3).

$$E=-n\mu S\frac{dH}{dt} \quad (3)$$

For both cores 1300 and 1302, the pickup coil values of n, μ and S are the same, but H is different. H for the bone shaped core 1302 has a bigger value than the H value for the traditional cylindrical core 1300. So, one can deduce that the electrodynamics force of the bone shaped core 1302 is bigger than that of the traditional cylindrical core 1300 by as much as 17.2 percent.

Because the electrodynamics force of the bone shaped core 1302 increased by 17.2 percent, the bone shaped core 1302 is considered as being able to collect more energy when it is placed in a magnetic field. Therefore, the bone shaped core 1302 is having a better detection performance in EAS/RFID detection system application than the traditional cylindrical core 1300.

Method for Providing a Marker

Figure 17:
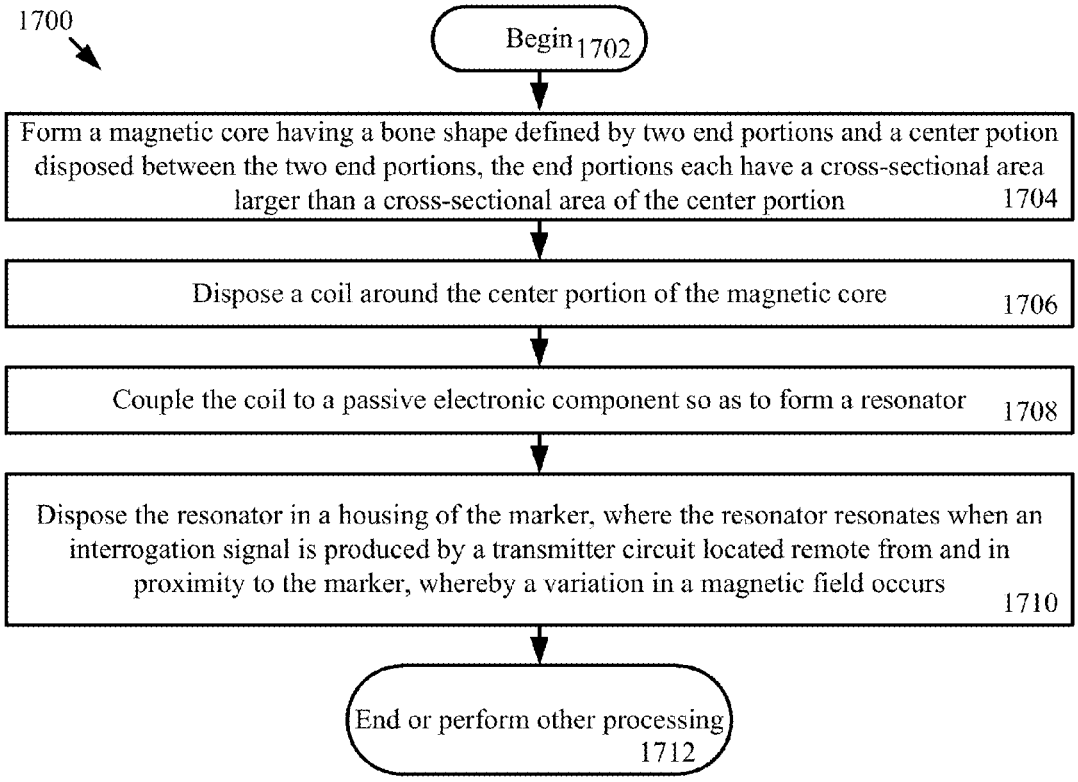
FIG. 17 is a flow diagram of an exemplary method for providing a marker.

Referring now to FIG. 17, there is provided a flow diagram of an exemplary method 1700 for providing a marker (e.g., marker 102 of FIG. 1). Method 1700 begins with step 1702 and continues with step 1704 where a magnetic core (e.g., magnetic core 200 of FIG. 2) is formed. The magnetic core has a bone shape defined by two end portions (e.g., end portions 208, 212 of FIG. 2) and a center potion (e.g., center portion 210 of FIG. 2) disposed between the two end portions. The end portions each have a cross-sectional area larger than a cross-sectional area of the center portion.

In a next step 1706, a coil (e.g., coil 224 of FIG. 2) is disposed around the center portion, and retained thereon by the two end portions. The coil is coupled to a passive electronic component (e.g., capacitor 206 of FIG. 2) so as to form a resonator (e.g., resonator 200 of FIG. 2), as shown by step 1708. For example, the coil is connected in series to form an LC resonator. Thereafter in step 1710, the resonator is disposed in a housing (e.g., housing 126 of FIG. 1) of the marker. The resonator resonates and mechanically vibrates when an interrogation signal is produced by a transmitter circuit (e.g., transmitter circuit 112 of FIG. 1) located remote from and in proximity to the marker, whereby a variation in a magnetic field occurs.

In some scenarios, the passive electronic component is positioned relative to the magnetic core such that the passive electronic component resides entirely within an area defined between the two end portions of the magnetic coil. Additionally or alternatively, the coil: has a uniform or non-uniform distribution about a length of the center portion of the magnetic core; and/or comprises at least two sets of windings that are spaced apart from each other. The windings of each set of windings are equally or not equally spaced apart along a respective segment of the center portion of the magnetic core. The sets of windings may have at least one of different spacing between the windings and different number of windings.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A method for providing a marker, comprising:

forming a magnetic core having a bone shape defined by two end portions and a center potion disposed between the two end portions, the end portions each have a cross-sectional area larger than a cross-sectional area of the center portion;

disposing a coil around the center portion of the magnetic core;

coupling the coil to a passive electronic component so as to form a resonator; and disposing the resonator in a housing of the marker, where the resonator resonates when an interrogation signal is produced by a transmitter circuit located remote from and in proximity to the marker, whereby a variation in a magnetic field occurs.

2. The method according to claim 1, wherein the passive electronic component comprises a capacitor that is coupled in series with the coil to form an inductor capacitor ("LC") resonator.

3. The method according to claim 1, wherein the marker comprises an Electronic Article Surveillance ("EAS") marker.

4. The method according to claim 1, wherein the end portions retain the coil on the center portion.

5. The method according to claim 1, wherein the passive electronic component is positioned relative to the magnetic core such that the passive electronic component resides entirely within an area defined between the two end portions of the magnetic coil.

6. The method according to claim 1, wherein the coil has a uniform distribution about a length of the center portion of the magnetic core.

7. The method according to claim 1, wherein the coil has a non-uniform distribution about a length of the center portion of the magnetic core.

8. The method according to claim 1, wherein the coil comprises at least two sets of windings that are spaced apart from each other.

9. The method according to claim 8, wherein the windings of each said set of windings are equally or not equally spaced apart along a respective segment of the center portion of the magnetic core.

10. The method according to claim 8, wherein the at least two sets of windings have at least one of different spacing between the windings and different number of windings.

11. A marker, comprising:

a magnetic core having a bone shape defined by two end portions and a center potion disposed between the two end portions, the end portions each have a cross-sectional area larger than a cross-sectional area of the center portion;

a coil disposed around the center portion of the magnetic core;

a passive electronic component connected to the coil so as to form a resonator; and a housing in which the resonator is disposed;

wherein the resonator resonates when an interrogation signal is produced by a transmitter circuit located remote from and in proximity to the marker, whereby a variation in a magnetic field occurs.

12. The marker according to claim 11, wherein the passive electronic component comprises a capacitor that is coupled in series with the coil to form an inductor capacitor ("LC") resonator.

13. The marker according to claim 11, wherein the marker comprises an Electronic Article Surveillance ("EAS") marker.

14. The marker according to claim 11, wherein the end portions retain the coil on the center portion.

15. The marker according to claim 11, wherein the passive electronic component is positioned relative to the magnetic core such that the passive electronic component resides entirely within an area defined between the two end portions of the magnetic coil.

16. The marker according to claim 11, wherein the coil has a uniform distribution about a length of the center portion of the magnetic core.

17. The marker according to claim 11, wherein the coil has a non-uniform distribution about a length of the center portion of the magnetic core.

18. The marker according to claim 11, wherein the coil comprises at least two sets of windings that are spaced apart from each other.

19. The marker according to claim 18, wherein the windings of each said set of windings are equally or not equally spaced apart along a respective segment of the center portion of the magnetic core.

20. The marker according to claim 18, wherein the at least two sets of windings have at least one of different spacing between the windings and different number of windings.

* * * * *